US010303092B2

(12) United States Patent
Nakano

(10) Patent No.: US 10,303,092 B2
(45) Date of Patent: May 28, 2019

(54) FIXING DEVICE AND IMAGE FORMING APPARATUS

(71) Applicant: KYOCERA Document Solutions Inc., Osaka (JP)

(72) Inventor: Kuniaki Nakano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/015,290

(22) Filed: Jun. 22, 2018

(65) Prior Publication Data

US 2019/0011866 A1 Jan. 10, 2019

(30) Foreign Application Priority Data

Jul. 10, 2017 (JP) ..... 2017-134883

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS 4,428,660 A * 1/1984 Matsumoto ..... G03G 15/2035 219/216
8,983,316 B2 3/2015 Mogi
9,841,710 B1 * 12/2017 Kanai ..... G03G 15/2028
2008/0181662 A1 * 7/2008 Lee ..... G03G 15/2032 399/126
2011/0097122 A1 * 4/2011 Okamoto ..... G03G 15/2032 399/329
2011/0222879 A1 * 9/2011 Okamoto ..... G03G 15/2032 399/44
2012/0033266 A1 * 2/2012 Kanai ..... G03G 15/2032 358/474
2013/0266349 A1 * 10/2013 Yoshimura ..... G03G 15/6585 399/320
2014/0064755 A1 3/2014 Mogi
2015/0277316 A1 * 10/2015 Tadomi ..... G03G 15/2025 399/327

FOREIGN PATENT DOCUMENTS

CN 202939413 U * 5/2013
JP 6071350 B2 2/2017

* cited by examiner

*Primary Examiner* — Francis C Gray
(74) *Attorney, Agent, or Firm* — Studebaker & Brackett PC

(57) ABSTRACT

A fixing device includes a fixing member, a pressing member, a pressure adjustment part and a linkage part. The pressing member forms a pressing area with the fixing member. The pressure adjustment part moves one of the fixing member and the pressing member in a direction close to the other of the fixing member and the pressing member to increase a pressure of the pressing area and moves one of the fixing member and the pressing member in a direction away from the other of the fixing member and the pressing member to decrease the pressure of the pressing area. The linkage part transmits an operation to decrease the pressure of the pressing area to the fixing member and then moves the fixing member along an axial direction.

7 Claims, 12 Drawing Sheets

FIXING DEVICE AND IMAGE FORMING APPARATUS

INCORPORATION BY REFERENCE

This application is based on and claims the benefit of priority from Japanese Patent application No. 2017-134883 filed on Jul. 10, 2017, which is incorporated by reference in its entirety.

BACKGROUND

The present disclosure relates to a fixing device and an image forming apparatus.

An electrophotographic type image forming apparatus is provided with a fixing device which fixes a toner on a medium.

The fixing device is sometimes provided with a reciprocation mechanism (a moving means) to move a heating unit (a heating belt) and a control part to control the reciprocation mechanism. The reciprocation mechanism includes a cam having a pair of inclined faces, a shaft engaged with the inclined face and a motor moving the cam with respect to the shaft. The control part executes an operation to drive the motor for a predetermined period every time when a predetermined number of sheet is passed through a nip and to move the heating unit within a region where a movement direction of the heating unit is changed. The control part repeats the operation intermittently. The above control makes it possible to reduce abrasion (damage) of the surface of the heating belt through which edges of the sheet are passed.

However, the above fixing device requires the motor moving the cam with respect to the shaft and the control part to control the motor. A structure of the reciprocation mechanism is complicated and a manufacturing cost is increased.

SUMMARY

In accordance with an aspect of the present disclosure, a fixing device includes a fixing member, a pressing member, a pressure adjustment part and a linkage part. The fixing member heats a toner on a medium while rotating around an axis. The pressing member forms a pressing area with the fixing member and presses the toner on the medium passing through the pressing area while rotating around an axis. The pressure adjustment part moves one of the fixing member and the pressing member in a direction close to the other of the fixing member and the pressing member to increase a pressure of the pressing area and moves one of the fixing member and the pressing member in a direction away from the other of the fixing member and the pressing member to decrease the pressure of the pressing area. The linkage part transmits an operation to decrease the pressure of the pressing area to the fixing member and then moves the fixing member along an axial direction.

In accordance with an aspect of the present disclosure, an image forming apparatus includes the fixing device.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an embodiment of the present disclosure will be described. In each figure, "Fr" indicates "a front side", "Rr" indicates "a rear side", "L" indicates "a left side", "R" indicates "a right side", "U" indicates "an upper side" and "D" indicates "a lower side".

Figure 1:
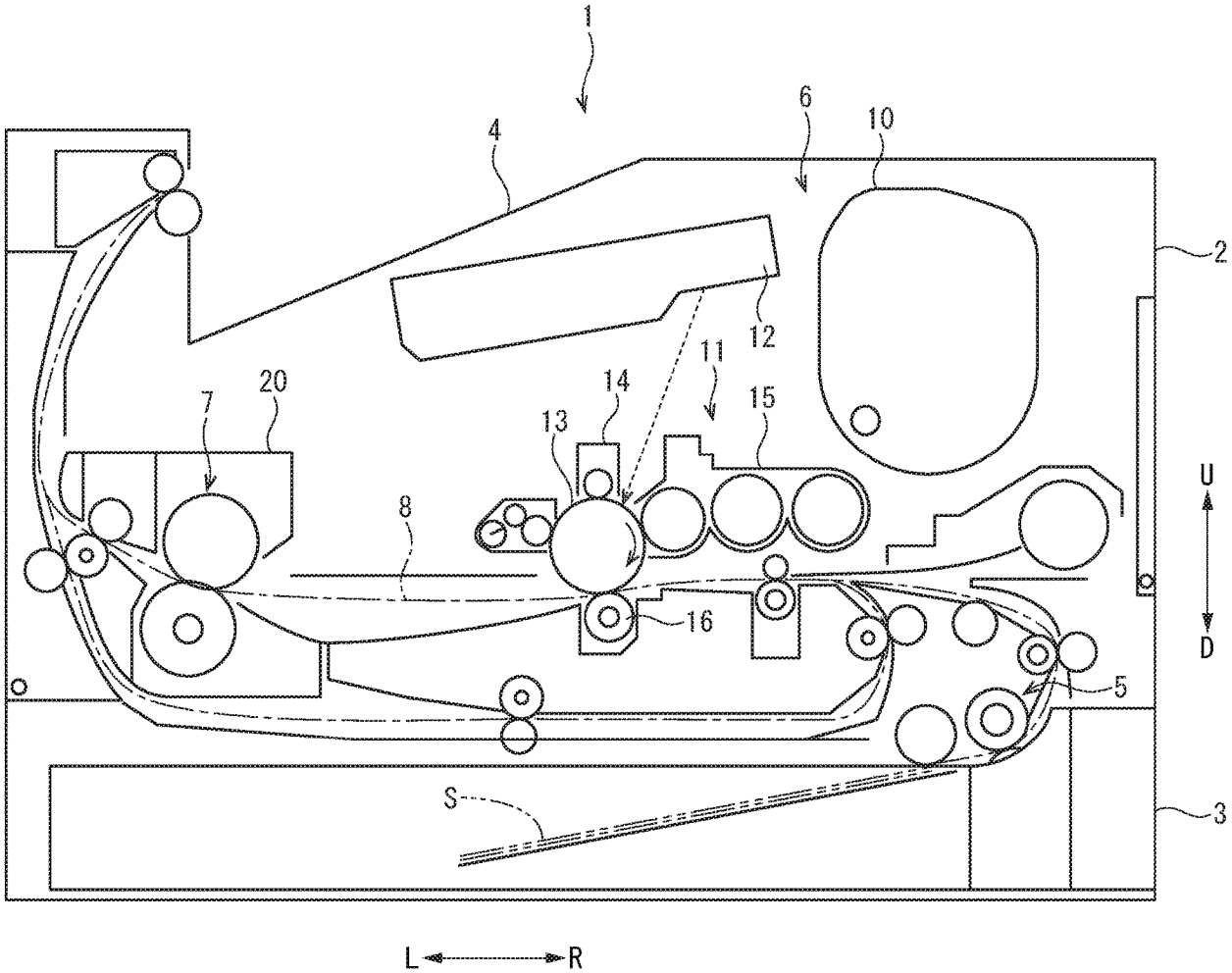
FIG. 1 is a front view schematically showing a printer according to one embodiment of the present disclosure.

[An Entire Structure of a Printer] With reference to FIG. 1, a printer 1 as an example of an image forming apparatus will be described. FIG. 1 is a front view schematically showing the printer 1. In the following description, "a conveying direction" indicates a direction along which a sheet S is conveyed. Additionally, "an upstream", "a downstream" and terms similar to these respectively show "an upstream", "a downstream" and concept similar to these in the conveying direction of the sheet S.

The printer 1 includes an apparatus main body 2 constituting an approximately parallelepiped appearance. In a lower portion of the apparatus main body 2, a sheet feeding cassette 3 storing the sheet S (a medium) such as a plain paper is provided. On an upper face of the apparatus main body 2, an ejected sheet tray 4 is provided. The sheet S is not limited to the paper sheet, and may include a resin sheet or the like.

The printer 1 is provided with a sheet feeding device 5, an image forming device 6 and a fixing device 7. The sheet feeding device 5 is provided at an upstream end portion of a conveying path 8 extending from the sheet feeding cassette 3 to the ejected sheet tray 4. The image forming device 6 is provided at an intermediate portion of the conveying path 8, and the fixing device 7 is provided at the downstream side portion of the conveying path 8.

The image forming device 6 includes a toner container 10, a drum unit 11 and an optical scanning device 12. The toner container 10 stores a black toner (a developer), for example. The drum unit 11 includes a photosensitive drum 13, a charging device 14, a developing device 15 and a transferring roller 16. The transferring roller 16 comes into contact with the photosensitive drum 13 from the lower side to form a transferring nip. The toner may be a two-component developer containing a toner and a carrier or a one-component developer containing a magnetic toner.

A control device (not shown) of the printer 1 suitably controls each device to execute the following image forming process. The charging device 14 charges a surface of the photosensitive drum 13. The photosensitive drum 13 is emitted with scanning light from the optical scanning device 12 to carry an electrostatic latent image. The developing device 15 develops the electrostatic latent image on the photosensitive drum 13 into a toner image using the toner supplied from the toner container 10. The sheet S is fed from the sheet feeding cassette 3 by the sheet feeding device 5 to the conveying path 8. The toner image on the photosensitive drum 13 is transferred on the sheet S passing through the transferring nip. The fixing device 7 fixes the toner image on the sheet S. Then, the sheet S is ejected on the ejected sheet tray 4.

[The Fixing Device]

Figure 2:
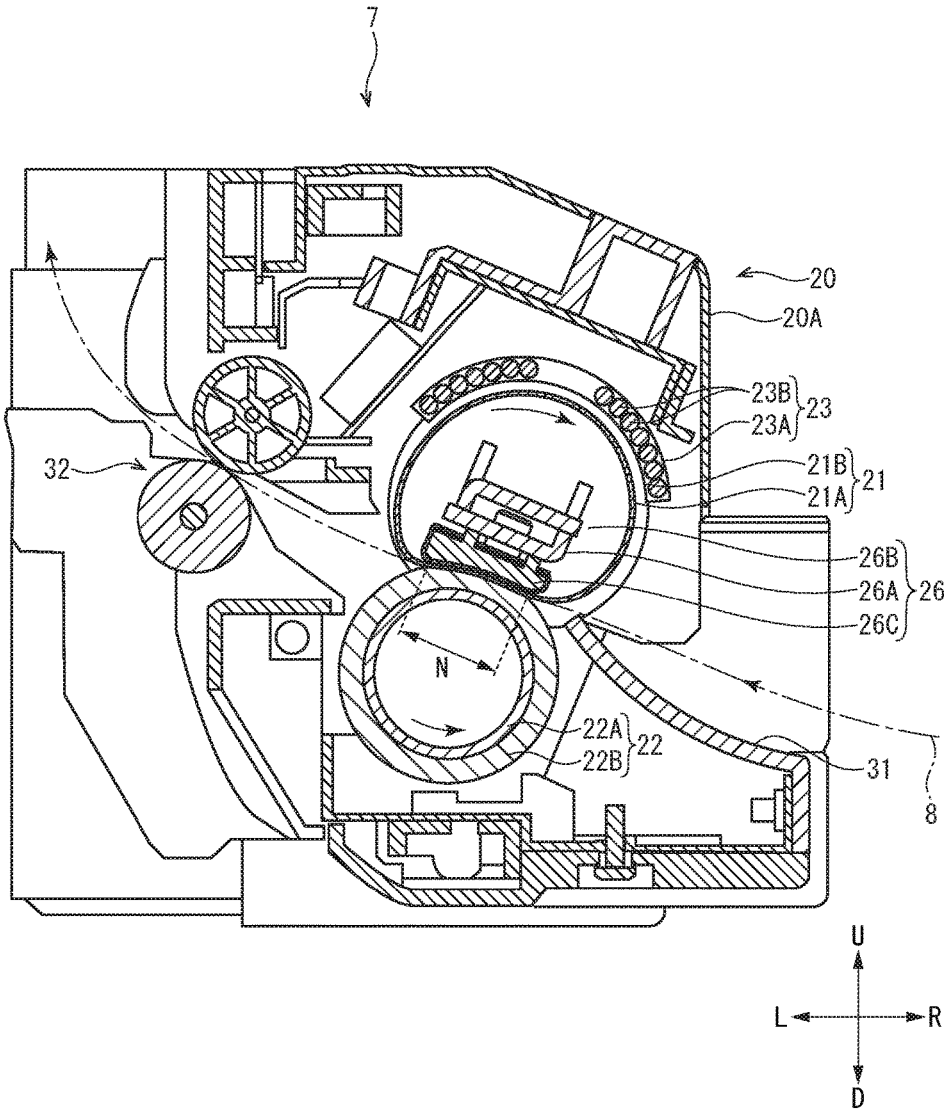
FIG. 2 is a sectional view showing a fixing device according to the embodiment of the present disclosure.
Figure 3:
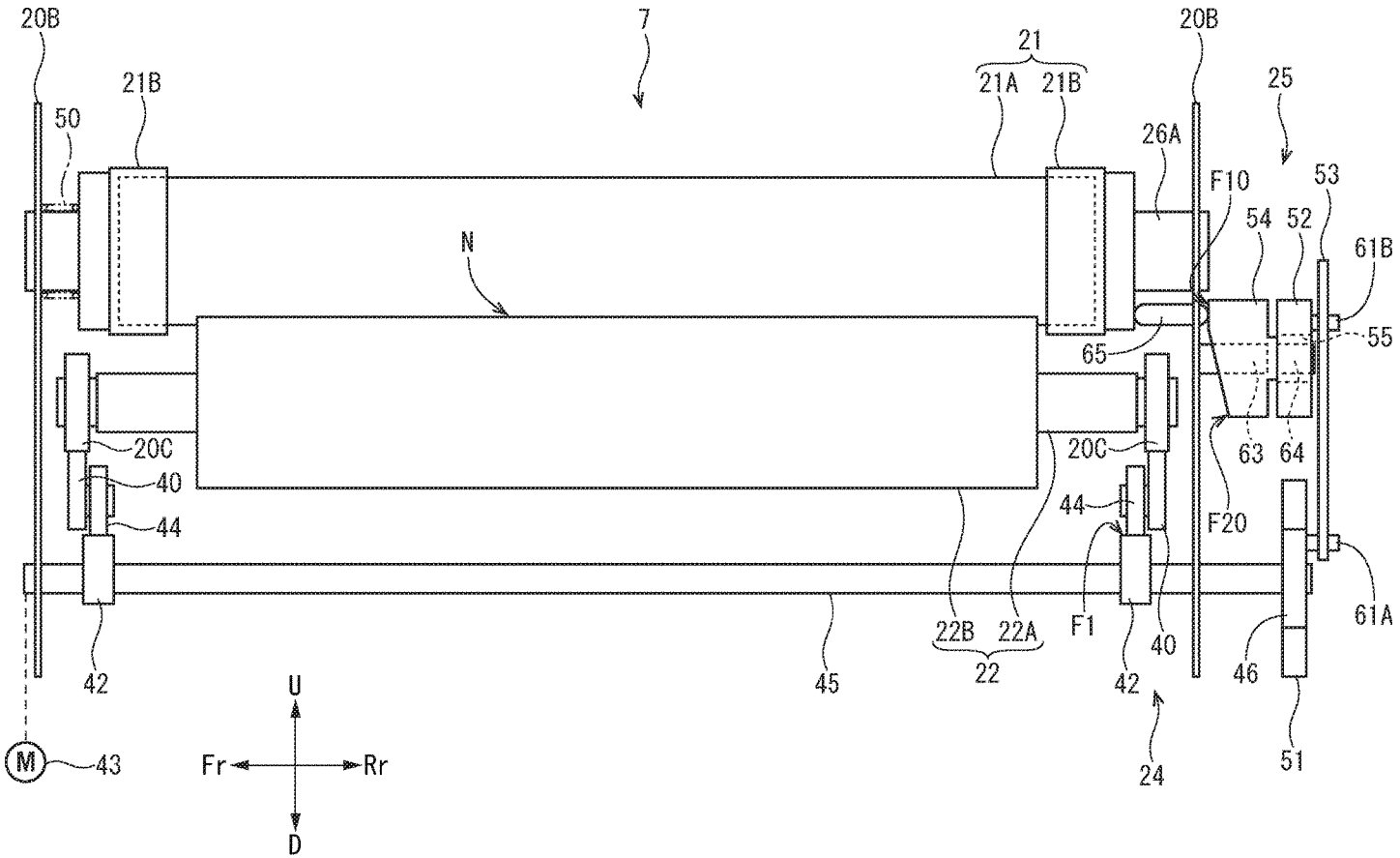
FIG. 3 is a side view showing an inner structure of the fixing device according to the embodiment of the present disclosure.
Figure 4:
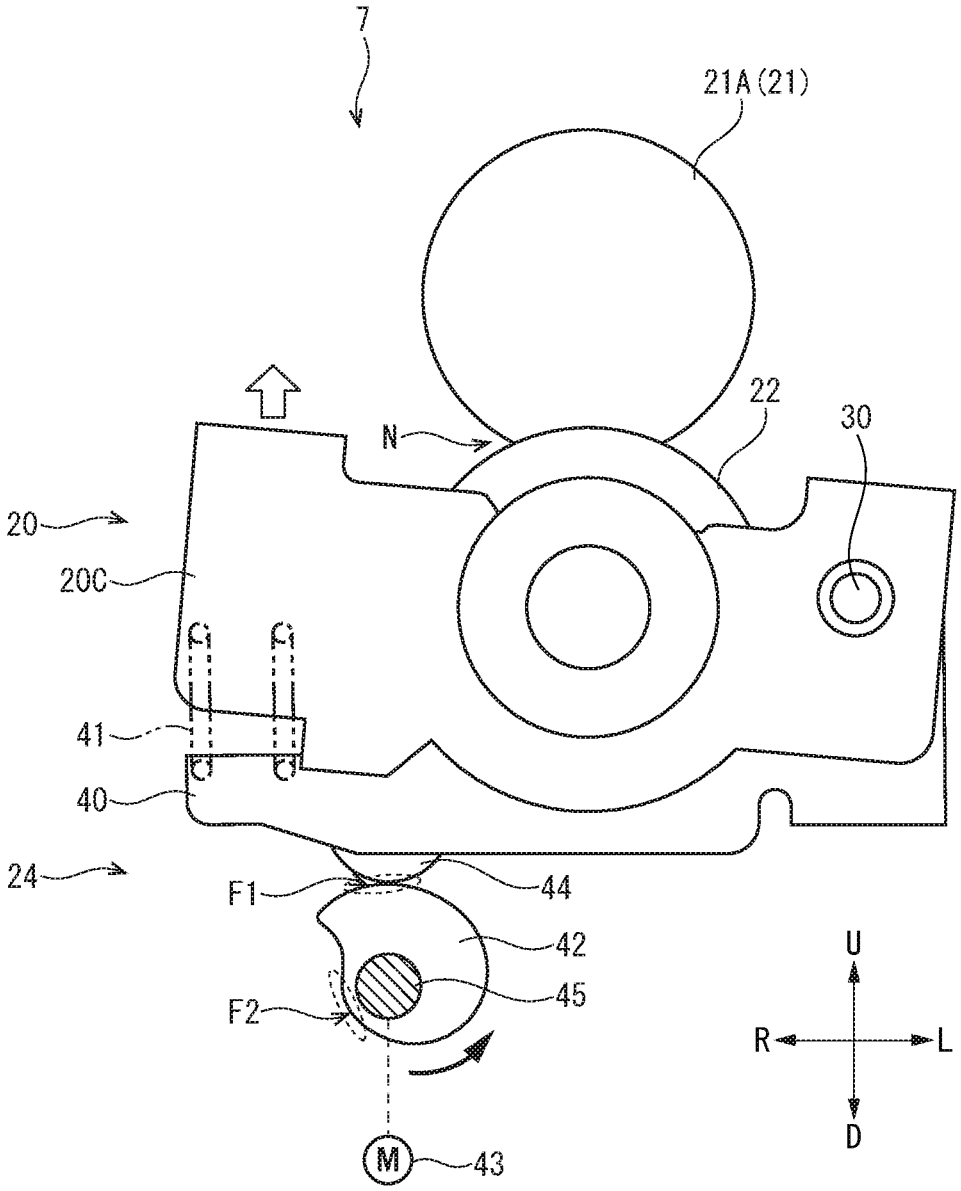
FIG. 4 is a back view showing a pressure adjustment part and the others (in a pressure increased state) of the fixing device according to the embodiment of the present disclosure.

Next, with reference to FIG. 2 to FIG. 5, the fixing device 7 will be described. FIG. 2 is a sectional view showing the fixing device 7. FIG. 3 is a side view showing an inner structure of the fixing device 7. FIG. 4 is a back view showing a pressure adjustment part 24 and the others (in a pressure increased state). FIG. 4 is a back view showing the pressure adjustment part 24 and the others (in a pressure decreased state).

As shown in FIG. 2 and FIG. 3, the fixing device 7 is provided with a casing 20, a fixing member 21, a pressing roller 22, a heating unit 23, a pressure adjustment part 24 and a linkage part 25. The fixing member 21 and the pressing roller 22 are provided inside the casing 20. The heating unit 23 is a heat source to heat the fixing member 21. The pressure adjustment part 24 is a unit to adjust a contact pressure of the pressing roller 22 against the fixing member 21. The linkage part 25 is a unit to reciprocate the fixing member 21 in an axial direction (a front-and-rear direction).

<The Casing>

As shown in FIG. 2 and FIG. 3, the casing 20 includes a case 20A, a pair of fixed metal plates 20B and a pair of movable metal plates 20C.

The case 20A is formed in an approximately parallelepiped rectangular shape elongated in the front-and-rear direction, and is supported inside the apparatus main body 2 (refer to FIG. 1). On both left and right side faces of the case 20A, openings through which the sheet S is passed are formed. In the right side opening of the case 20A, an insertion guide 31 is provided, which introduces the sheet S to a contact portion (a pressing area N) between a fixing belt 21A included in the fixing member 21 and the pressing roller 22. In the left side opening of the case 20A, a conveying roller pair 32 is provided, which feeds the sheet S to the downstream side (refer to FIG. 2). The pair of fixed metal plates 20B are arranged with an interval in the front-and-rear direction, and are fixed inside the case 20A (refer to FIG. 3). The pair of movable metal plates 20C are arranged with an interval in the front-and-rear direction inside the pair of fixed metal plates 20B. The pair of movable metal plates 20C are supported by left end portions of the pair of fixed metal plates 20B via turning shafts 30 (refer to FIG. 4). The movable metal plate 20C is supported in a turnable manner around the turning shaft 30.

<The Fixing Member>

As shown in FIG. 2 and FIG. 3, the fixing member 21 includes the fixing belt 21A and a pair of caps 21B.

The fixing belt 21A is an endless belt formed in an approximately cylindrical shape elongated in the front-and-rear direction. An outer layer of the fixing belt 21A is made of heat resistant and elastic synthetic resin, such as polyimide resin, for example. The pair of caps 21B are attached to both end portions of the fixing belt 21A in the axial direction. The cap 21B comes in tightly contact with an outer face of the end portion of the fixing belt 21A via an annular elastic member (not shown).

As shown in FIG. 2, a pressing mechanism 26 is provided inside the fixing belt 21A. The pressing mechanism 26 includes a supporting member 26A and a pressing member 26C.

The supporting member 26A is formed in an approximately rectangular cylindrical shape elongated in the front-and-rear direction, and is made of metal, for example. The supporting member 26A penetrates through the fixing member 21 (the fixing belt 21A and the caps 21B) in the axial direction, and is supported by the pair of fixed metal plates 20B. The fixing member 21 is supported so as to be rotatable and movable in the axial direction with respect to the supporting member 26. The pressing member 26C is a thick plate-like member made of heat resistant resin, and is fixed on a lower face of the supporting member 26A. The pressing member 26C has a function to receive the fixing belt 21A pressed against the pressing roller 22. Inside the fixing belt 21A, a belt guide (not shown) is provided, which keeps the fixing belt 21A an approximately cylindrical shape. The belt guide is made of high magnetic permeability alloy, and is heated by the heating unit 23.

<The Pressing Roller>

As shown in FIG. 2 and FIG. 3, the pressing roller 22 as an example of a pressing member is formed in an approximately cylindrical shape elongated in the front-and-rear direction. The pressing roller 22 includes a core metal 22A made of metal and an elastic layer 22B made of silicon sponge, for example, laminated on an outer face of the core metal 22A. Both front and rear end portions of the core metal 22A are supported by upper portions of the pair of movable metal plates 20C in a rotatable manner. To the core metal 22A, a drive motor (not shown) is connected via a gear train. The pressing roller 22 is driven by the drive motor to be rotated.

<The Heating Unit>

As shown in FIG. 2, the heating unit 23 is arranged above the fixing belt 21A with an interval. The heating unit 23 includes a unit case 23A and an IH coil 23B. The unit case 23A is formed in an approximately semi-cylindrical shape elongated in the front-and-rear direction along an outer face of an upper portion of the fixing belt 21A. The IH coil 23B is provided inside the unit case 23A. The IH coil 23B is applied with high frequency current to generate magnetic field which heats the upper portion of the fixing belt 21A.

The casing 20 is provided with a temperature sensor (not shown) to detect a surface temperature of the fixing belt 21A.

<The Pressure Adjustment Part>

As shown in FIG. 3 and FIG. 4, the pressure adjustment part 24 includes a pair of pressing arms 40, a pair of pressing springs 41, a pair of eccentric cams 42 and a cam motor 43. FIG. 3 does not show the pressing spring 41.

The pair of pressing arms 40 are arranged below the pair of movable metal plates 20C. The pair of pressing arms 40 are supported by the turning shafts 30 of the movable metal plates 20C in a turnable manner. On inner faces of lower portions of the pair of pressing arms 40, a pair of operation rollers 44 are supported in a rotatable manner. The pair of pressing springs 41 are coil springs, and are arranged at right side portions of the pair of pressing arms 40. The pressing spring 41 is interposed between the movable metal plate 20C and the pressing arm 40. The pressing spring 41 biases the movable metal plate 20C and the pressing arm 40 in a direction to separate them each other.

The pair of eccentric cams 42 are fixed to a cam coupling shaft 45 extending in the front-and-rear direction. The pair of eccentric cams 42 correspond to the pair of movable metal plates 20C (the pair of pressing arms 40). The cam coupling shaft 45 is arranged at the right lower side of the pressing roller 22 in almost parallel to the pressing roller 22. Both end portions (both front and rear end portions) of the cam coupling shaft 45 in the axial direction are supported by the pair of fixed metal plates 20B in a rotatable manner. The rear end portion of the cam coupling shaft 45 penetrates through the rear fixed metal plate 20B and protrudes rearward. To the rear end portion of the cam coupling shaft 45, a transmission gear 46 is fixed.

The eccentric cam 42 is a disk cam in which a distance (an eccentric radius) between a rotation center (the cam coupling shaft 45) and the outer face is not constant. The operation rollers 44 of the above pair of pressing arms 40 are biased by the pressing springs 41 and pressed against the outer faces (cam faces) of the eccentric cams 42. Around the outer face of the eccentric cam 42, a curved face containing a pressure increasing cam face F1 and a pressure decreasing cam face F2 is continuously formed. The eccentric radius of the pressure increasing face F1 is larger than the eccentric radius of the pressure decreasing cam face F2. The eccentric cam 42 has the curved face around which the eccentric radius is continuously increased or decreased within an entire area containing the pressure increasing face F1 and the pressure decreasing cam face F2.

The cam motor 43 as a drive source is connected to the front end portion of the cam coupling shaft 45 via a gear train (not shown). The cam motor 43 is electrically connected to the control device of the printer 1 via a drive circuit and is controlled to be driven. The cam motor 43 drives the eccentric cam 42 (the cam coupling shaft 45) to rotate it.

<An Operation of the Pressure Adjustment Part>

When the cam motor 43 is driven to rotate the eccentric cams 42 normally and inversely around the cam coupling shaft 45, the pressing arms 40 reciprocate (turn) in the upper-and-lower direction around the turning shafts 30. In the description of the present embodiment, a rotation in the clockwise direction in FIG. 4 (also FIG. 6, FIG. 7B, FIG. 8B and FIG. 9B) is called as "a normal rotation", a rotation in the counterclockwise direction is called as "an inverse rotation" and a rotation reciprocating in the clockwise direction and in the counterclockwise direction alternately is called as "a normal and inverse rotation".

For example, as shown in FIG. 4, in a state where the pressure increasing face F1 of the eccentric cam 42 comes into contact with the operation roller 44, the pressing arm 40 (the operation roller 44) and the movable metal plate 20C are pushed up. Thereby, the pressing roller 22 is forcefully pressed against the fixing belt 21A and bitten into the fixing belt 21A. That is, the pressing area N formed between the fixing belt 21A and the pressing roller 22 is shifted to a pressure increased state.

Figure 5:
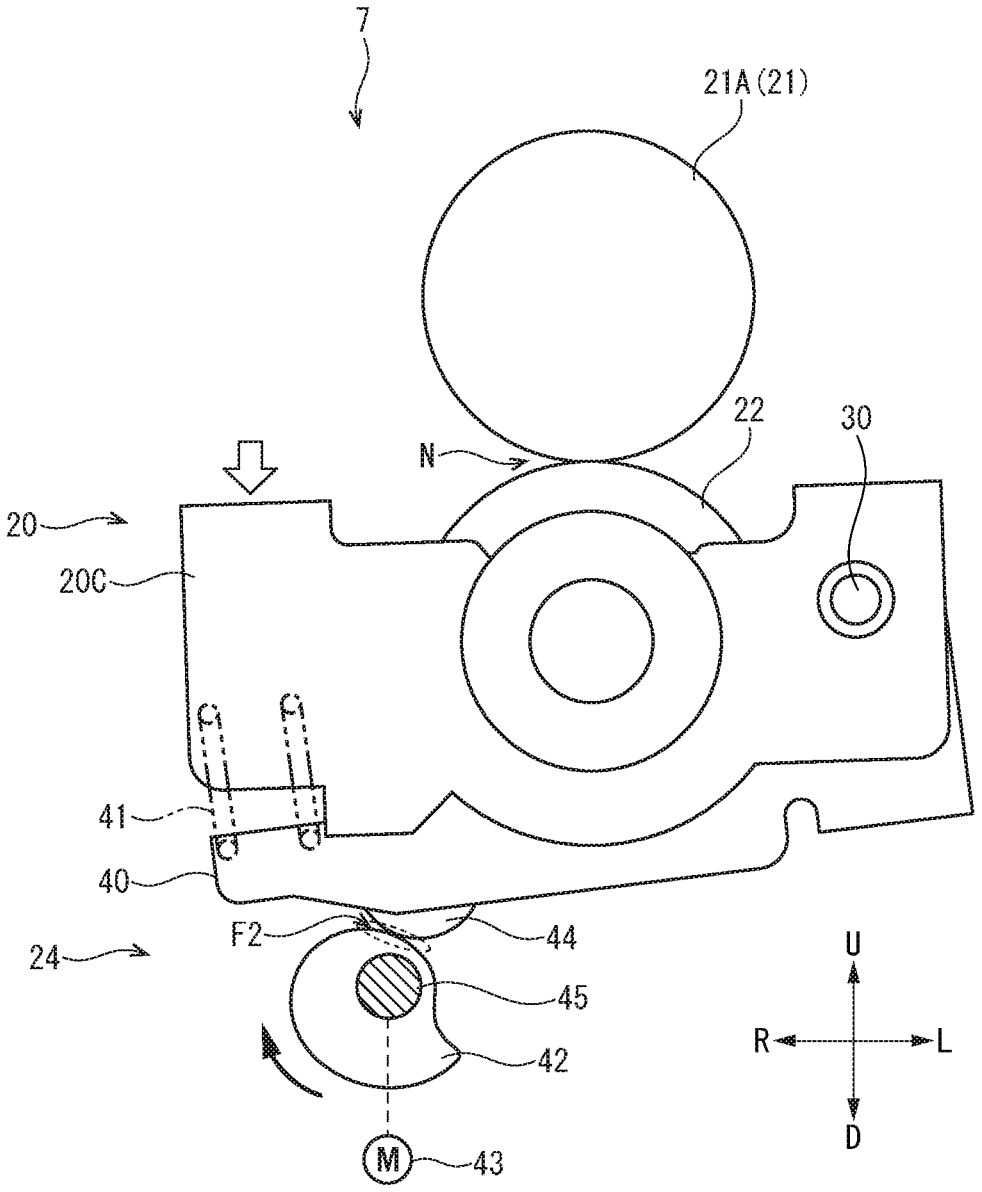
FIG. 5 is a back view showing the pressure adjustment part and the others (at a pressure decreased state) of the fixing device according to the embodiment of the present disclosure.

As shown in FIG. 5, when the eccentric cam 42 rotates inversely until the pressure decreasing cam face F2 comes into contact with the operation roller 44, the pressing arm 40 and the movable metal plate 20C are moved downward. Then, the pressing roller 22 is moved in a direction away from the fixing belt 21A, and the pressure of the pressing area N is decreased (a pressure decreased state). When the eccentric cam 42 rotates normally from the pressure decreased state and the pressure increasing cam face F1 comes into contact with the operation roller 44, the pressing area N is shifted to the pressure increased state again (refer to FIG. 4).

As described above, the eccentric cam 42 rotates normally and inversely around the cam coupling shaft 45 while coming into contact with the supporting member (the movable metal plate 20C, the pressing arm 40 and the others) supporting the pressing roller 22, and moves the pressing roller 22 upward and downward with respect to the fixing member 21 (moves the pressing roller 22 in directions close to and away from the fixing member 21). The pressure adjustment part 24 moves the pressing roller 22 in the direction close to the fixing member (the fixing belt 21A) to increase the pressure of the pressing area N, and moves the pressing roller 22 in the direction away from the fixing member 21 to decrease the pressure of the pressing area N. The pressing area N indicates an area from an upstream side position where the pressure is 0 Pa to a downstream side position where the pressure is 0 Pa through a position where the pressure increases to a maximum pressure.

The above heating unit 23 (the IH coil 23B), the drive motor and the temperature sensor are electrically connected to the control device of the printer 1 via various drive circuits. The control device controls the components connected thereto.

[An Operation of the Fixing Device]

With reference to FIG. 2, an operation (a fixing process) of the fixing device 7 will be described. When the fixing process is performed, the pressing area N is set to be the pressure increased state.

First, the control device controls the drive motor and the heating unit 23 to drive them. The pressing roller 22 is driven by the drive motor to be rotated, and the fixing member 21 (the fixing belt 21A) is driven by the pressing roller 22 to be rotated (refer to a thin solid line arrow in FIG. 2). The heating unit 23 heats the fixing belt 21A. The temperature sensor detects the surface temperature of the fixing belt 21A, and sends a detection signal to the control device via the input circuit. When the detection signal showing that the surface temperature reaches a set temperature (for example, 150 to 200° C.) is received by the control device from the temperature sensor, the control device begins to perform the above described image forming operation while controlling the heating unit 23 to keep the surface temperature the set temperature. The sheet S on which the toner image is transferred enters the casing 20, and then the fixing belt 21A heats the toner (the toner image) on the sheet S passing through the pressing area N while rotating normally around the axis. The pressing roller 22 presses the toner on the sheet S passing through the pressing area N while rotating around the axis. As a result, the toner image is fixed on the sheet S. The sheet S on which the toner image is fixed is conveyed to an outside of the casing 20, and then ejected on the ejected sheet tray 4.

When the printer 1 (the fixing device 7) is stopped (waited), when a conveying failure (a sheet jam) of the sheet S is occurred in the casing 20 (the pressing area N) or when the image forming process (the fixing process) is subjected to a medium easy to be wrinkled, such as an envelope, the control device controls the cam motor 43 to drive such that the pressing area N is shifted to the pressure decreased state.

In such a fixing device 7, the sheet S is conveyed between the fixing belt 21A and the pressing roller 2. When the fixing device 7 performs the fixing processing repeatedly and edges (both side edges in the width direction) of the sheet S repeatedly pass through approximately the same portion of the fixing belt 21A, the outer layer (the outer face) of the fixing belt 21A may be damaged (abraded). Then, the fixing device 7 of the present embodiment includes a linkage part 25 to transmit the operation for decreasing the pressure of the pressing area N to the fixing member 21 and then to move the fixing member 21 in the axial direction in order to reduce the abrasion of the surface of the fixing belt 21A due to the edges of the sheet S.

<The Linkage Part>

Figure 6:
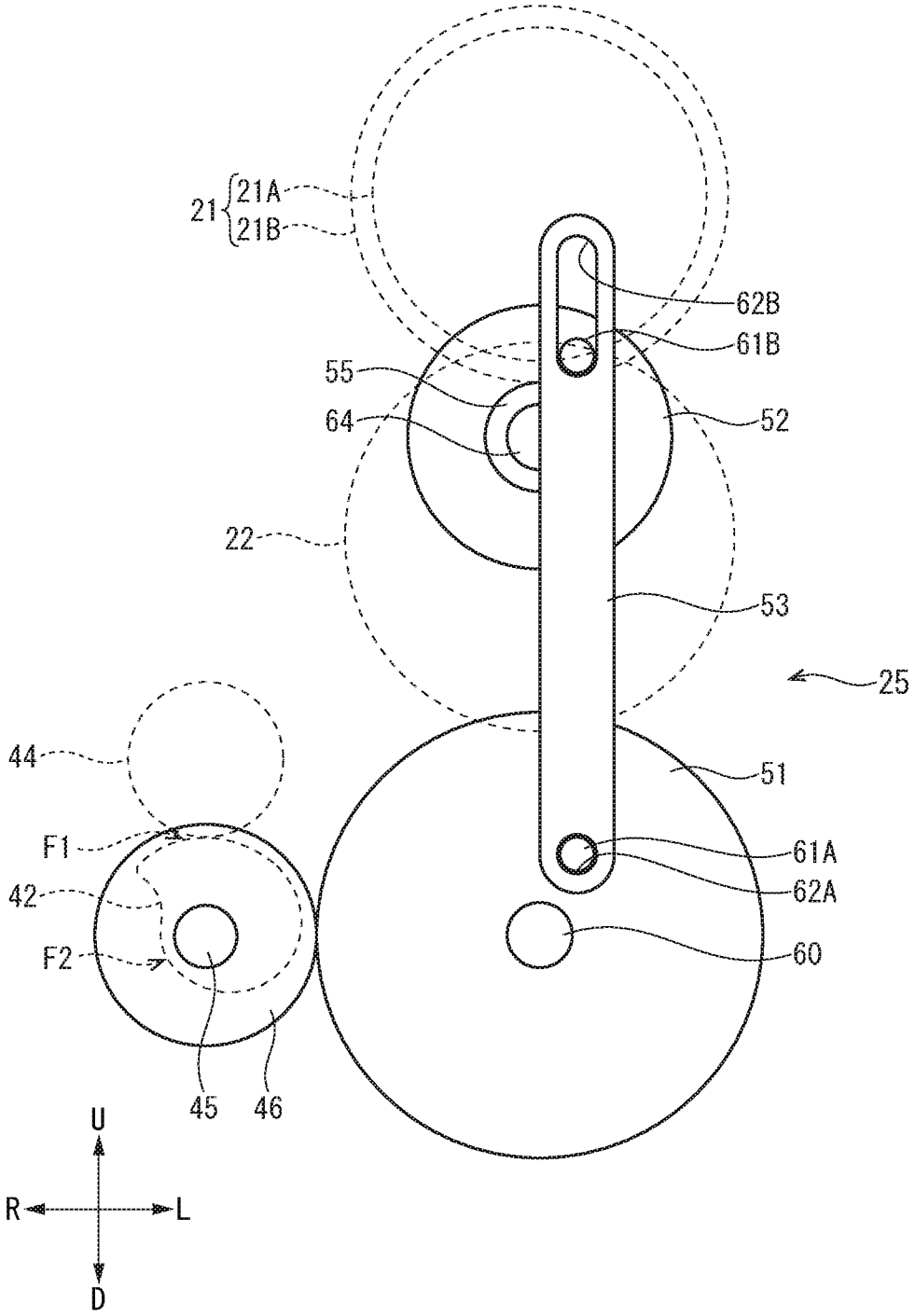
FIG. 6 is a back view showing a linkage part and the others of the fixing device according to the embodiment of the present disclosure.

With reference to FIG. 3 and FIG. 6, the linkage part 25 will be described. FIG. 6 is a back view showing the linkage part and the others.

The linkage part 25 includes a link spring 50, a first rotation body 51, a second rotation body 52, a link 53, an inclined face cam 54 and a one-way clutch 55. Almost of the linkage part 25 is arranged at the rear side of the rear fixed metal plate 20B.

As shown in FIG. 3, the link spring 50 as an example of a biasing member is a coil spring, and is arranged in the front of the fixing member 21. The link spring 50 is interposed between the front cap 21B and the front fixed metal plate 20B. The link spring 50 biases the fixing member 21 rearward (in one direction in the axial direction).

As shown in FIG. 3 and FIG. 6, the first rotation body 51 is an approximately disk-shaped gear, and is supported in a rotatable manner by a first rotation shaft 60 extending rearward from the rear fixed metal plate 20B. The first rotation shaft 60 is arranged below the pressing roller 22 and at the left side of the cam coupling shaft 45, and extends in parallel to the pressing roller 22 and the others. The first rotation body 51 is meshed with the transmission gear 46 fixed to the rear end portion of the cam coupling shaft 45. Thereby, the first rotation body 51 rotates normally and inversely around the axis with the eccentric cam 42. On a rear face of the first rotation body 51, an approximately cylindrical first projection 61A is formed. The first projection 61A protrudes rearward from the rear face of the first rotation body 51 at a position close to a center of the first rotation body 51 (the first rotation shaft 60).

The second rotation body 52 is an approximately disk-like shape having a smaller diameter than that of the first rotation body 51. The second rotation body 52 is supported in a rotatable manner by a support shaft 64 extending rearward from the inclined face cam 54. The second rotation body 52 rotates normally and inversely around an axis extending parallel to the axis of the first rotation body 51. The second rotation body 52 is arranged above the first rotation body 51. In detail, a center of the second rotation body 52 is arranged on a perpendicular line extending vertically from the center of the first rotation body 51 (the first rotation shaft 60). A rear face of the second rotation body 52 is substantially on the same face as the rear face of the first rotation body 51. On the rear face of the second rotation body 52, an approximately cylindrical second projection 61B is formed. The second projection 61B protrudes rearward from the rear face of the second rotation body 52.

The link 53 is formed in a long narrow plate. At both end portions in the longitudinal direction of the link 53, a first coupling hole 62A and a second coupling hole 62B are formed. The first coupling hole 62A is a circular hole into which the first projection 61A is fitted in a rotatable state. The second coupling hole 62B is a long hole elongated in the longitudinal direction of the link 53. Into the second coupling hole 62B, the second projection 61B is fitted in a movable state. The second coupling hole 62B extends in the longitudinal direction of the link 53. The first coupling hole 62A is coupled to the first projection 61A of the first rotation body 51, and the second coupling hole 62B is coupled to the second projection 61B of the second rotation body 52. Thereby, the link 53 is coupled between the first rotation body 51 and the second rotation body 52, and transmits the rotation of the first rotation body 51 to the second rotation body 52.

If the link 53 (the coupling holes 62A and 62B) is arranged on a linear line connecting a center of the first rotation body 51 and a center of the second rotation body 52, the rotations of the first rotation body 51 and the others are restricted. Thereby, the link 53 is arranged at a position displaced from the centers of the first rotation body 51 and the others in the left-and-right direction. For example, in the present embodiment, in a case where the pressing area N is in the pressure increased state, the first projection 61A is positioned at the left oblique side of the center of the first rotation body 51, and the second projection 61B is positioned at the left oblique side of the center of the second rotation body 52 (refer to FIG. 6). The second projection 61B is positioned at a lower end portion of the second coupling hole 62B (refer to FIG. 6).

The inclined face cam 54 is formed in an approximately columnar shape whose front end face is inclined. The inclined face cam 54 is supported in a rotatable manner by a second rotation shaft 63 extending rearward from the rear fixed metal plate 20B. On a rear end face of the inclined face cam 54, a support shaft 64 which supports the second rotation body 52 in a rotatable manner is formed. The support shaft 64 is formed on the same axis as the second rotation shaft 63. Thereby, the inclined face cam 54 is provided on the same axis as the second rotation body 52.

The front end face (the inclined face) of the inclined face cam 54 is inclined with respect to the second rotation shaft 63. An annular cam face is formed outside the inclined face in a radial direction. On the annular cam face, an inclined face containing a push-in cam face F10 and a push-back cam face F20 is continuously formed. The push-in cam face F10 is formed on an opposite side to the push-back cam face F20 with respect to a rotation center. The push-in cam face F10 is a most forwardly protruding portion among the inclined face cam 54. The push-back cam face F20 is a most rearward portion among the inclined face cam 54. The front end face of the inclined face cam 54 is inclined symmetrical with a line connecting the rotation center and the two cam faces F10 and F20 as a symmetrical center.

The front end face (the inclined face) of the inclined face cam 54 comes into contact with the rear end portion of the fixing member 21 (the rear cap 21B) via a pressing transmission member 65. The pressing transmission member 65 is formed in an approximately rod shape, and is supported in a reciprocatable manner in the axis direction with respect to the rear fixed metal plate 20B. A front end portion of the pressing transmission member 65 comes into contact with a lower rear face of the rear cap 21B in a slidable state. A rear end portion of the pressing transmission member 65 comes into contact with the front end face of the inclined face cam 54 (the annular cam face) in a slidable state. The inclined face cam 54 rotates normally around the axis via the pressing transmission member 65 to vary a push-in amount of the inclined face cam 54 against the fixing member 21 forward (in the other direction in the axial direction).

The one-way clutch 55 is provided between the second rotation body 52 and the inclined face cam 54. In detail, an outer ring of the one-way clutch 55 is fitted into a bearing part of the second rotation body 52, and the support shaft 64 of the inclined face cam 54 is fitted into an inner ring of the one-way clutch 55. The one-way clutch 55 is configured to transmit the normal rotation of the second rotation body 52 to the inclined face cam 54 and to restrict a transmission (not to transmit) of the inverse rotation of the second rotation body 52 with respect to the inclined face cam 54.

<An Operation of the Linkage Part>

Figure 7A:
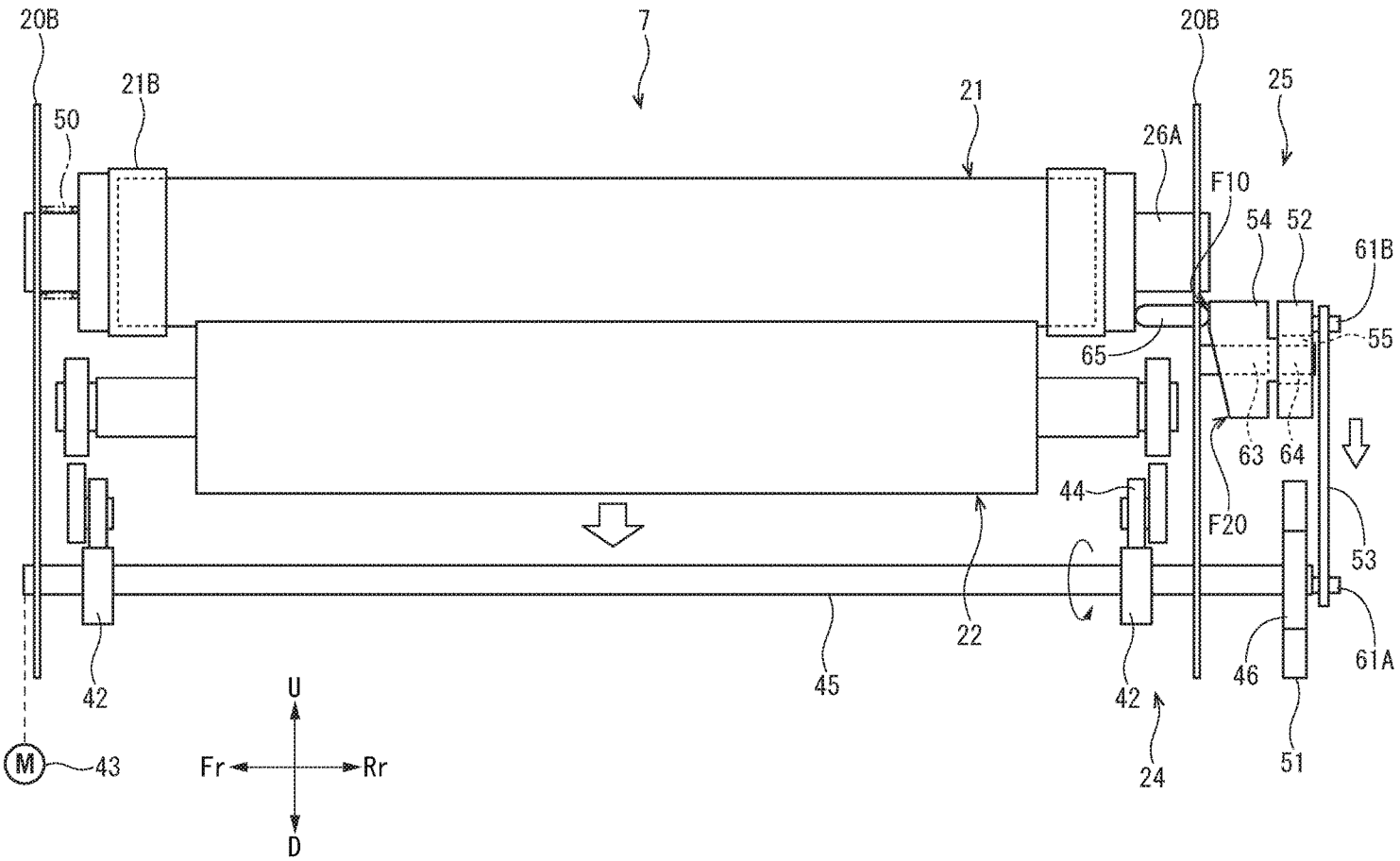
FIG. 7A is a side view showing the inner structure of the fixing device, in a process where a pressing area is shifted from the pressure increased state to the pressure decreased state, according to the embodiment of the present disclosure.
Figure 7B:
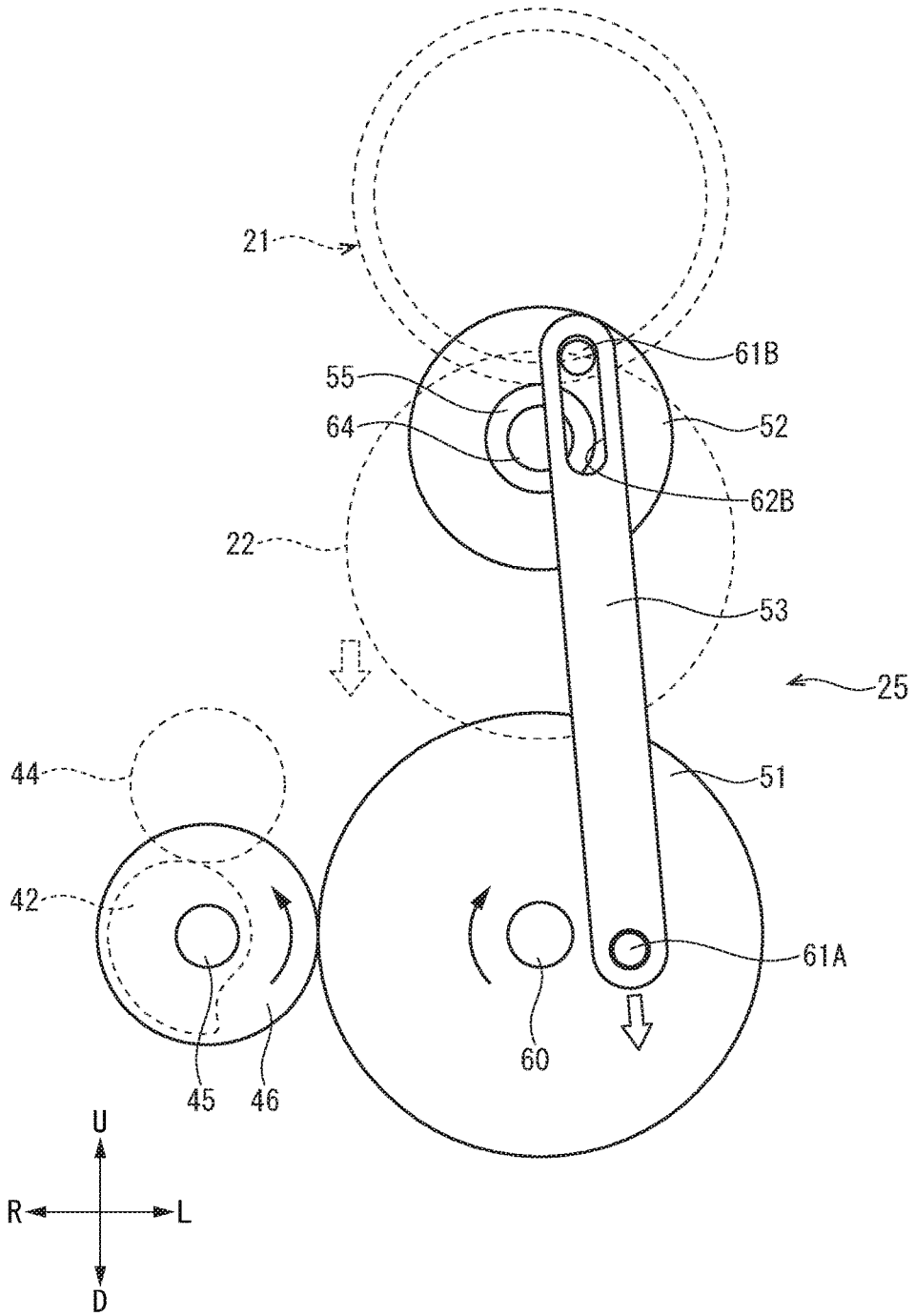
FIG. 7B is a back view showing the linkage part and the others, in the process where the pressing area is shifted from the pressure increased state to the pressure decreased state, in the fixing device according to the embodiment of the present disclosure.
Figure 8A:
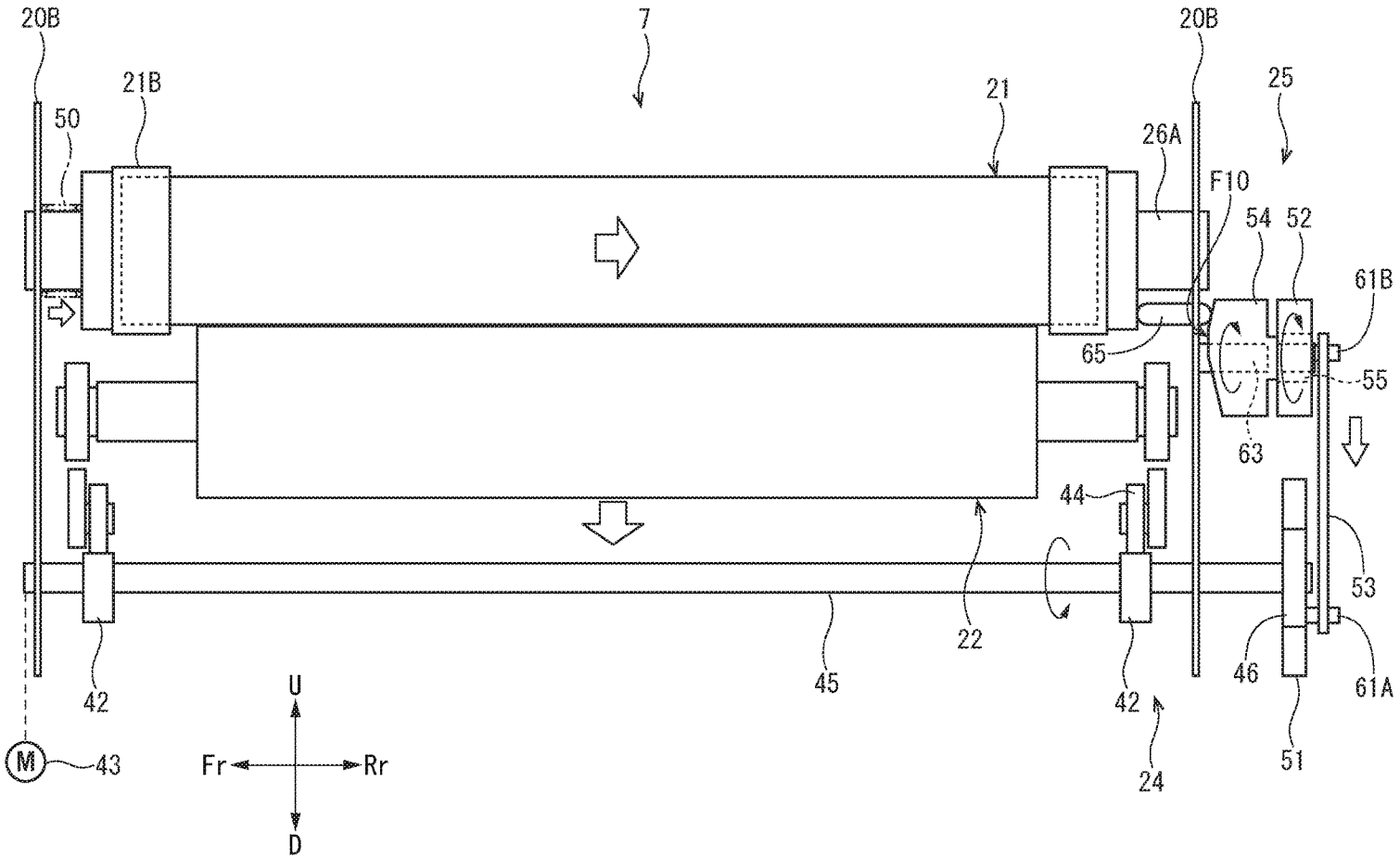
FIG. 8A is a side view showing the inner structure of the fixing device (in the pressure decreased state) according to the embodiment of the present disclosure.
Figure 8B:
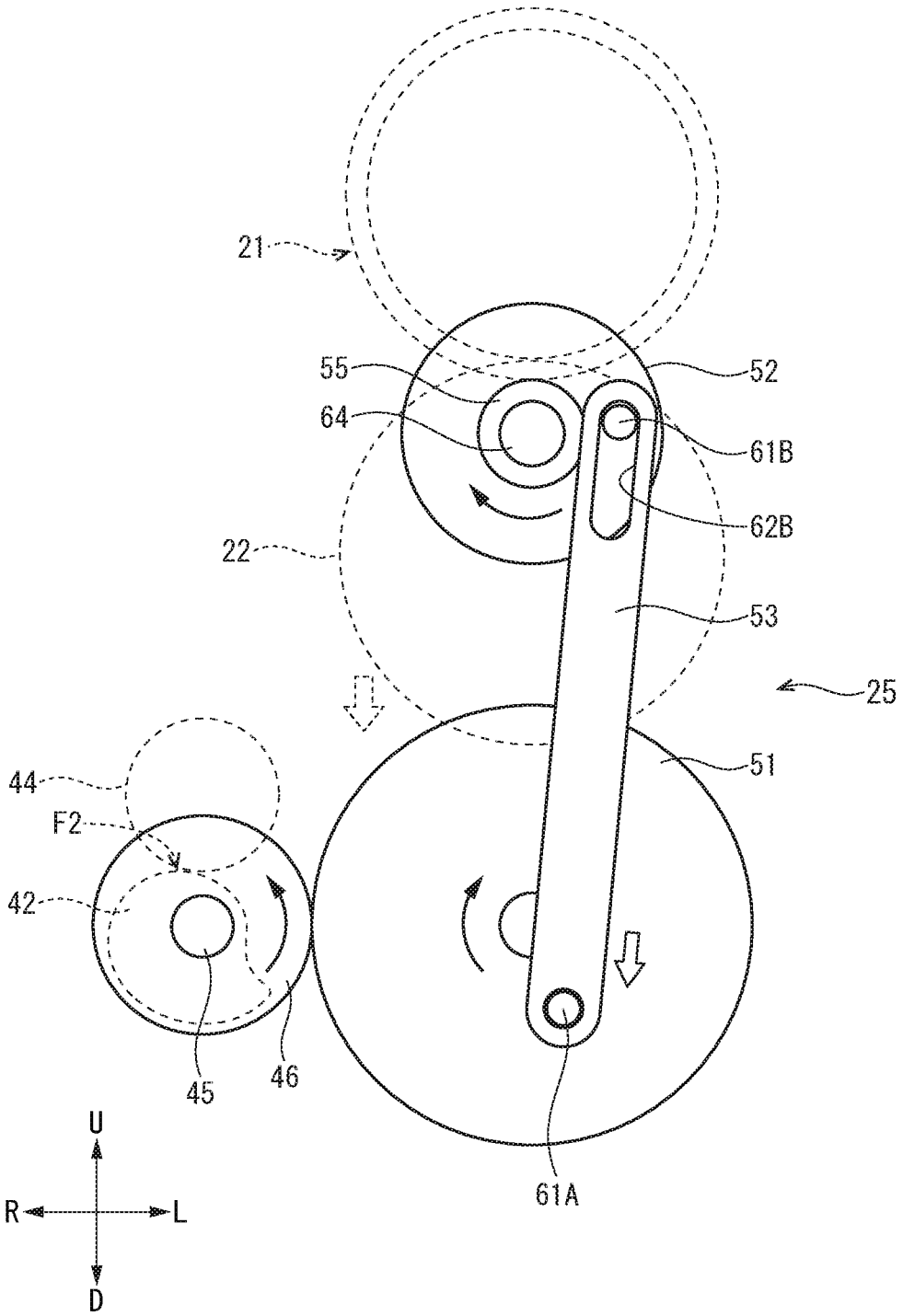
FIG. 8B is a back view showing the linkage part and the others (in the pressure decreased state) of the fixing device according to the embodiment of the present disclosure.
Figure 9A:
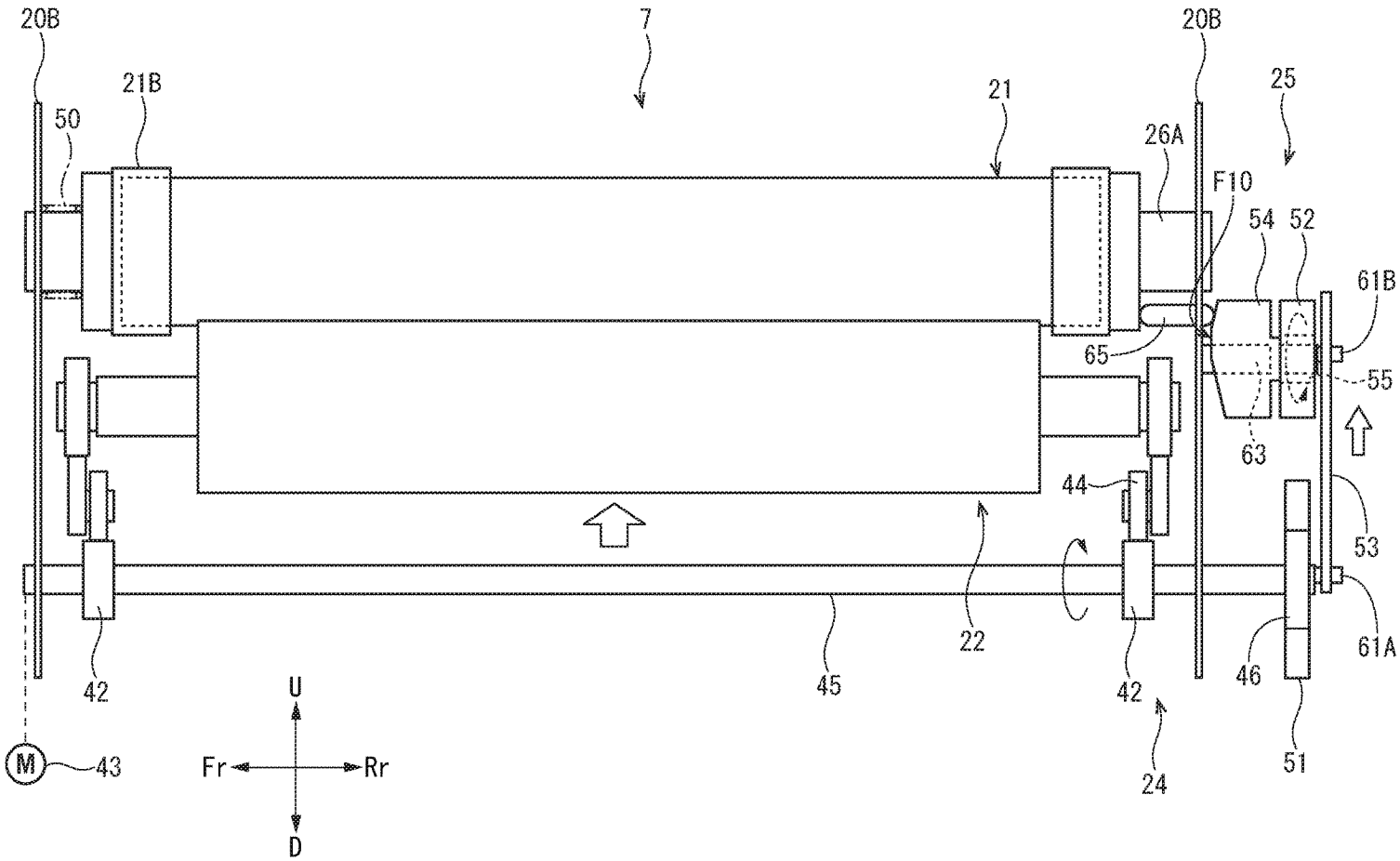
FIG. 9A is a side view showing the inner structure of the fixing device, in a process where the pressing area is sifted from the pressure decreased state to the pressure increased state, according to the embodiment of the present disclosure.
Figure 9B:
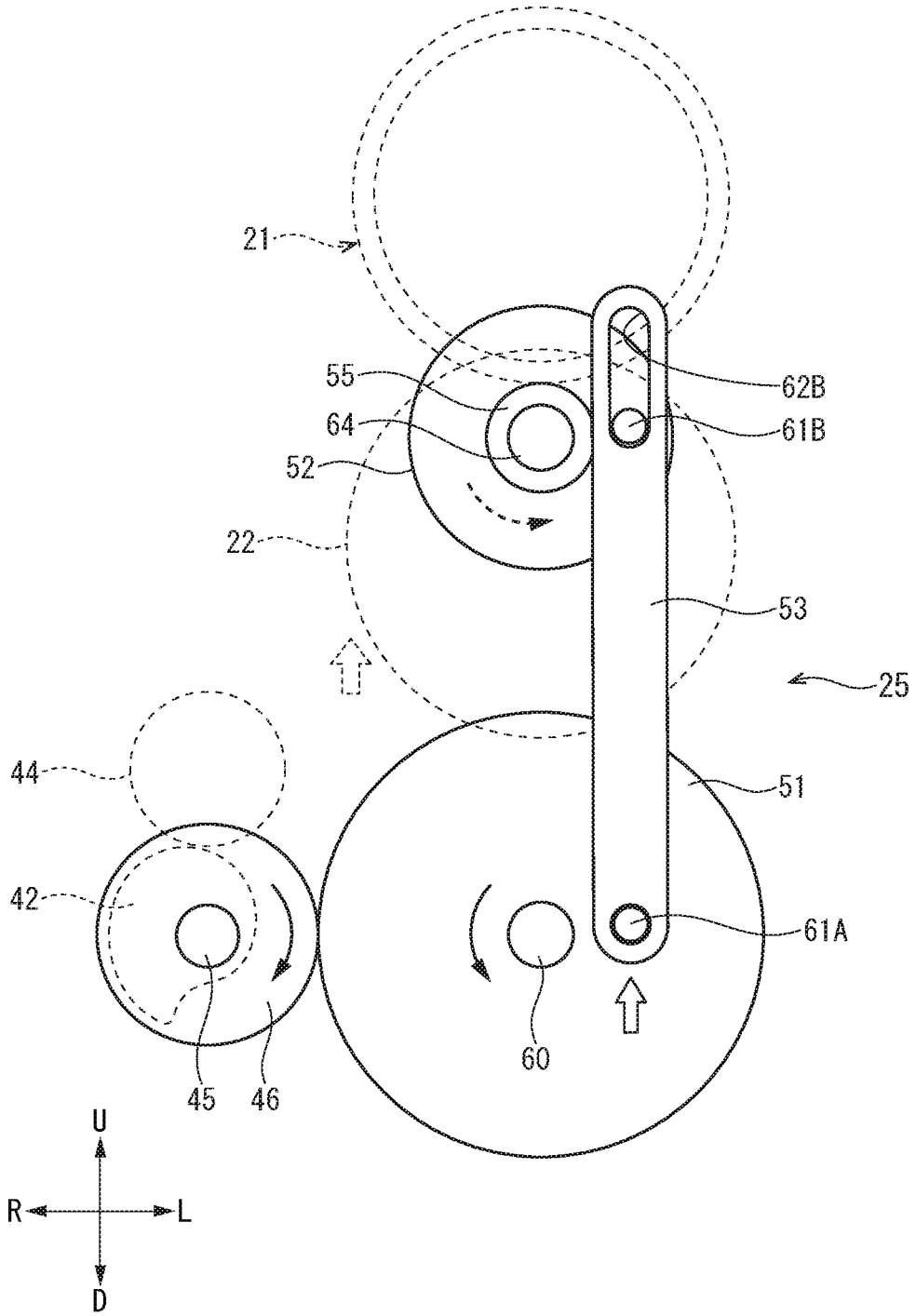
FIG. 9B is a back view showing the linkage part and the others, in the process where the pressing area is sifted from the pressure decreased state to the pressure increased state, in the fixing device according to the embodiment of the present disclosure.

With reference to FIG. 3, FIG. 6, FIG. 7A, FIG. 7B, FIG. 8A, FIG. 8B, FIG. 9A and FIG. 9B, the operation of the linkage part 25 will be described. FIG. 7A is a side view showing the inner structure of the fixing device 7, in a process where the pressing area N is shifted from the pressure increased state to the pressure decreased state. FIG. 7B is a back view of the linkage part 25 and the others, in the process where the pressing area N is shifted from the pressure increased state to the pressure decreased state. FIG. 8A is a side view of the inner structure of the fixing device 7 (in the pressure decreased state). FIG. 8B is a back view of the linkage part 25 and the others (in the pressure decreased state). FIG. 9A is a side view of the inner structure of the fixing device 7, in a process where the pressing area N is shifted from the pressure decreased state to the pressure increased state. FIG. 9B is a back view of the linkage part 25 and the others, in the process where the pressing area N is shifted from the pressure decreased state to the pressure increased state. Here, a state (the pressure increased state) where the pressure increasing cam face F1 of the eccentric cam 42 comes into contact with the operation roller 44 (refer to FIG. 3 and FIG. 6) is set to an initial state. In the initial state, the pressing transmission member 65 comes into contact with the push-in cam face F10 of the inclined face cam 54, and the fixing member 21 is positioned at a position (a most front position) where it is pushed in mostly on the inclined face cam 54 against the biasing force of the link spring 50 (refer to FIG. 3).

(Shift from the pressure increased state to the pressure decreased state) As shown in FIG. 7A and FIG. 7B, when the control device starts the drive of the cam motor 43, the eccentric cam 42 and the transmission gear 46 rotate inversely around the cam coupling shaft 45. The first rotation body 51 meshed with the transmission gear 46 rotates normally to pull the link 53 down.

With the pull down of the link 53, the second projection 61B of the second rotation body 52 is relatively moved upward in the second coupling hole 62B (refer to FIG. 6 and FIG. 7B). At this time, although the first rotation body 51 rotates normally, the second rotation body 52 is stopped. As described, the second coupling hole 62B moves the second projection 61B along the second coupling hole 62B to idle the first rotation body 51 temporarily.

As shown in FIG. 7B, when the first rotation body 51 further rotates normally (the link 53 is further pulled down), the second projection 61B reaches an upper end portion of the second coupling hole 62B and then begins to be pulled down with the link 53. Then, as shown in FIG. 8A and FIG. 8B, the second rotation body 52 begins to rotate normally. The normal rotation of the second rotation body 52 is transmitted to the inclined face cam 54 via the one-way clutch 55, and the inclined face cam 54 rotates normally. The pressing transmission member 65 begins to move relatively in a direction from the push-in cam face F10 toward the push-back cam face F20 of the inclined face cam 54. Then, because the push-in amount of the inclined cam face 54 against the fixing member 21 is reduced, the fixing member 21 is biased by the link spring 50 and begins to move rearward (in the one direction in the axial direction) (refer to FIG. 8A).

When the pressure decreasing cam face F2 of the eccentric cam 42 comes into contact with the operation roller 44 (the pressure decreased state) (refer to FIG. 8B), the control device stops the drive of the cam motor 43, and the inverse rotations of the eccentric cam 42 and the transmission gear 46 are stopped. In addition, the normal rotations of the first rotation body 51, the second rotation body 52 and the inclined face cam 54 are stopped. Because the first rotation body 51 idles temporarily, a rotation angle of the second rotation body 52 is smaller than a rotation angle of the first rotation body 51 (less than a half of the rotation angle of the first rotation body 51). Thereby, because a rotation angle of the inclined face cam 54 is small, the fixing member 21 is held in a state where it is pressed against the pressing transmission member 65 by the link spring 50 at a position where it is slightly moved rearward.

(Shift from the pressure decreased state to the pressure increased state) Next, a case where the pressing area N is shifted from the pressure decreased state to the pressure increased state (the initial state) will be described. As shown in FIG. 9A and FIG. 9B, when the control device begins to drive the cam motor 43, the eccentric cam 42 and the transmission gear 46 rotate normally around the cam coupling shaft 45. The first rotation body 51 rotates inversely to push the link 53 up.

With the push up of the link 53, the second projection 61B of the second rotation body 52 is relatively moved downward in the second coupling hole 62B (refer to FIG. 8B and FIG. 9B). At this time, although the first rotation body 51 rotates inversely, the second rotation body 52 is stopped. That is, the first rotation body 51 idles.

As shown in FIG. 9B, when the first rotation body 51 further rotates inversely (the link 53 is further pushed up), the second projection 61B reaches the lower end portion of the second coupling hole 62B, and then begins to be pushed up together with the link 53. Then, the second rotation body 52 begins to rotate inversely (refer to a broken line arrow in FIG. 7A and FIG. 7B). The inverse rotation of the second rotation body 52 is restricted by the one-way clutch 55, and then the second rotation body 52 idles. Thereby, the inclined face cam 54 and the fixing member 21 are stopped.

Then, when the pressure increasing cam face F1 of the eccentric cam 42 comes into contact with the operation roller 44 (the pressure increased state) (refer to FIG. 6), the control device stops to drive the cam motor 43, and the normal rotations of the eccentric cam 42 and the transmission gear 46 are stopped. In addition, the inverse rotations of the first rotation body 51 and the second rotation body 52 are stopped, and the first projection 61A, the second projection 61B and the link 53 are returned to their original positions (the initial state) (refer to FIG. 3 and FIG. 6). The fixing member 21 is held at the position where it is slightly moved rearward when the pressing area N is shifted from the pressure increased state to the pressure decreased state. The pressing roller 22 is pressed against the fixing belt 21A of the fixing member 21 moved slightly rearward.

When the above pressure decreasing of the pressing area N by the pressure adjustment part 24 is repeated, the inclined face cam 54 normally rotates by a predetermined angle (an approximately constant angle), and the fixing member 21 moves rearward by a predetermined distance (an approximately constant distance). That is, when the pressing transmission member 65 relatively moves from the push-in cam face F10 toward the push-back cam face F20, because the push-in amount of the inclined face cam 54 is gradually reduced, the fixing member 21 is gradually moved rearward (in the one direction in the axial direction). On the other hand, after the fixing member 21 moves from the position where it is pushed in mostly (the most front position) to a position where it is biased by the link spring 50 and pushed back mostly (a most rear position), the pressing transmission member 65 relatively moves from the push-back cam face F20 toward the push-in cam face F10. In this case, the push-in amount of the inclined cam face 54 is gradually increased, and then the fixing member 21 gradually moves forward (in the other direction in the axial direction). As described above, every time when the pressure adjustment part 24 decreases the pressure of the pressing area N, the linkage part 25 reciprocates the fixing member 21 in the axial direction stepwisely.

As described above, the fixing device 7 of the present embodiment has a configuration that the linkage part 25 mechanically links the pressure decreasing operation by the pressure adjustment part 24 with the movement in the axial direction (the reciprocation) of the fixing member 21. That is, the linkage part 25 converts the drive force (the drive force of the cam motor 43) to decrease the pressure of the pressing area N by the pressure adjustment part 24 to the drive force to move the fixing member 21 in the axial direction. By the configuration, as a result of the shift of the pressing area N from the pressure increased state to the pressure decreased state, it becomes possible to move the fixing belt 21A automatically in the axial direction. Thereby, compared with a case where a motor for moving the fixing member 21 is separately provided and the control device controls the motor, it becomes possible to make the configuration to move the fixing member 21 (the configuration of the linkage part 25) simple and inexpensive. In addition, because the contact position between the fixing member 21 and the sheet S is displaced in the axial direction, it becomes possible to reduce the abrasion of the surface of the fixing member 21 due to the edges of the sheet S.

The fixing device 7 of the present embodiment has a configuration that the linkage part 25 moves the fixing member 21 in a process where the pressing area N is shifted from the pressure increased state to the pressure decreased state. By the configuration, compared with a case where the fixing member 21 is moved while keeping the pressing area N in the pressure increased state, it becomes possible to move the fixing member 21 with a smaller force. Thereby, it becomes possible to lower the load applied to the fixing member 21 at the contact position with the pressing roller 22.

The fixing device 7 of the present embodiment has a configuration that the linkage part 25 moves the fixing member 21 gradually forward and rearward (reciprocates) with the repeated operation to decrease the pressure of the pressing area N by the pressure adjustment part 24. In the other words, every time when the pressure adjustment part 24 decreases the pressure of the pressing area N, the linkage part 25 moves the fixing member 21 by a predetermined distance forward and rearward (reciprocates). By the configuration, it becomes possible to distribute the contact position between the surface of the fixing member 21 and the edges of the sheet S in several positions along the axial direction of the fixing member 21. Thereby, it becomes possible to reduce the abrasion of the surface of the fixing member 21 effectively.

The fixing device 7 of the present embodiment has a configuration that the first rotation body 51, the link 53 and the second rotation body 52 transmit the rotation of the eccentric cam 42 to the inclined face cam 54, and the inclined face cam 54 changes the position in the axial direction of the fixing member 21 biased by the link spring 50 (the push-in amount of inclined cam face 54 against the fixing member 21). By the configuration, it becomes possible to use the cam motor 43 to move the pressing roller 22 upward and downward as a drive source to reciprocate the fixing member 21 in the axial direction. Thereby, compared with a case where a motor for moving the fixing member 21 is separately provided, it becomes possible to make the configuration of the linkage part 25 simple and inexpensive.

The fixing device 7 of the present embodiment has a configuration that the rotation of the first rotation body 51 is not transmitted to the second rotation body 52 while the second projection 61B of the second rotation body 52 moves along the second coupling hole 62B. By the configuration, it becomes possible to make the rotation angle of the second rotation body 52 (the inclined face cam 54) smaller than the rotation angle of the first rotation body 51 (the eccentric cam 42). Thereby, it becomes possible to fine the stepwise movement amount of the fixing member 21 and to distribute the contact position between the surface of the fixing member 21 and the edges of the sheet S.

In the fixing device 7 of the present embodiment, the pressing roller 22 is driven to be rotated, and the fixing member 21 is driven by the pressing roller 22 to be rotated. The present disclosure is not limited to the present embodiment, and the fixing member 21 may be driven to be rotated and the pressing roller 22 is driven by the fixing member 21 to be rotated.

In the fixing device 7 of the present embodiment, the heating unit 23 is applied as a heat source. However, another heater, such as a halogen heater or a carbon heater, may be provided in the hollow space of the fixing belt 21A, in place of the heating unit 23.

In the fixing device 7 of the present embodiment, the pressure adjustment part 24 moves the pressing roller 22 upward and downward with respect to the fixing member 21 (moves the pressing roller 22 in directions close to and away from the fixing member 21). The present disclosure is not limited to the present embodiment. For example, the fixing member 21 may be moved in directions to close and away from the pressing roller 22.

In the fixing device 7 of the present embodiment, the linkage part 25 moves the fixing member 21 by an approximately constant distance. The present disclosure is not limited to the present embodiment. For example, a shape of the cam face (the cam profile) of the inclined face cam 54 may be changed such that the fixing member 21 is moved by a different distance every time when the pressure adjustment part 24 decreases the pressure of the pressing area N. Alternatively, the cam profile of the inclined face cam 54 may be changed such that the linkage part 25 gradually moves the fixing member 21 in the one direction in the axial direction and moves the fixing member 21 at once in the other direction in the axial direction by a maximum movement distance. In addition, the linkage part 25 reciprocates the fixing member 21, however, the linkage part 25 moves the fixing member 21 only in the one direction in the axial direction. The second coupling hole 62 is a long hole, however, may be a circular hole into which the second projection 61B is fitted in a rotatable state.

In the description of the present embodiment, a rotation in the clockwise direction is set to be "a normal rotation" and a rotation in the counterclockwise direction is set to be "an inverse rotation". The present disclosure is not limited thereto. For example, a rotation in the clockwise direction is set to be "an inverse rotation" and a rotation in the counterclockwise direction is set to be "a normal rotation".

In the description of the present embodiment, the present disclosure is applied to a mono color printer 1. The present disclosure may be applied to a color printer, a copying machine, a facsimile or a multifunctional peripheral.

While the above description has been described with reference to the particular illustrative embodiments of the image forming apparatus according to the present disclosure, a technical range of the disclosure is not to be restricted by the description and illustration of the embodiment.

The invention claimed is:

1. A fixing device comprising:

a fixing member heating a toner on a medium while rotating around an axis;

a pressing member forming a pressing area with the fixing member and pressing the toner on the medium passing through the pressing area while rotating around an axis;

a pressure adjustment part moving one of the fixing member and the pressing member in a direction close to the other of the fixing member and the pressing member to increase a pressure of the pressing area and moving one of the fixing member and the pressing member in a direction away from the other of the fixing member and the pressing member to decrease the pressure of the pressing area; an a linkage part transmitting an operation to decrease the pressure of the pressing area to the fixing member and then moving the fixing member along an axial direction, wherein the pressure adjustment part includes:

an eccentric cam rotating normally and inversely around an axis while coming into contact with a member by which the pressing member is supported, the eccentric cam moving the pressing member in a direction close to or a direction away from the fixing member; and a drive source rotating the eccentric cam, the linkage part includes:

a biasing member biasing the fixing member in one direction along the axial direction;

a first rotation body to which a rotation of the eccentric cam is transmitted, and rotating normally and inversely around an axis;

a second rotation body rotating normally and inversely around an axis parallel to the axis of the first rotating body;

a link interposed between the first rotation body and the second rotation body and transmitting a rotation of the first rotation body to the second rotation body;

an inclined face cam provided on the same axis as the second rotating body, rotating normally around an axis and varying a push-in amount of the inclined face cam to the fixing member in the other direction along the axial direction; and a one-way clutch provided between the second rotation body and the inclined face cam, transmitting a normal rotation of the second rotation body to the inclined face cam and restricting a transmission of an inverse rotation of the second rotation body with respect to the inclined face cam.

2. The fixing device according to claim 1, wherein the linkage part moves the fixing member gradually in one direction or in the other direction along the axial direction as the pressure adjustment part repeatedly decreases the pressure of the pressing area.

3. The fixing device according to claim 1, wherein the linkage part moves the fixing member in one direction or in the other direction along the axial direction by a predetermined distance every time when the pressure adjustment part decreases the pressure of the pressing area.

4. The fixing device according to claim 1, wherein the fixing member reciprocates along the axial direction.

5. The fixing device according to claim 1, comprising a pressing transmission member supported between the inclined face cam and the fixing member in a movable manner in the axial direction of the fixing member and converting a rotation of the inclined face cam to a movement of the fixing member in the axial direction.

6. The fixing member according to claim 1, wherein the link has:

a first coupling hole coupled to a first projection of the first rotation body; and a second coupling hole coupled to a second projection of the second rotation body, wherein the second coupling hole is a long hole elongated in a longitudinal direction of the link, and by moving the second projection along the second coupling hole, the first rotation body idles temporarily.

7. An image forming apparatus including the fixing device according to claim 1.

* * * * *